United States Patent [19]

Di Michele et al.

[11] 4,032,880

[45] June 28, 1977

[54] ELECTRICAL DEVICE

[75] Inventors: Aldo Di Michele, Chicago; John D. Gallas, Roselle; Frank W. Grimm, Chicago, all of Ill.

[73] Assignee: Drestech Corporation, Chicago, Ill.

[22] Filed: Mar. 8, 1976

[21] Appl. No.: 664,707

[52] U.S. Cl. ..... 338/157; 338/174; 338/184; 338/202

[51] Int. Cl.[2] ..... H01C 10/28

[58] Field of Search ..... 338/157, 158, 152, 163, 338/125, 167, 92, 95, 97, 143, 149, 155, 174, 184, 199, 202

[56] References Cited

UNITED STATES PATENTS 2,141,770 12/1938 Solomon ..... 338/157 X

*Primary Examiner*—C. L. Albritton
*Attorney, Agent, or Firm*—McDougall, Hersh & Scott

[57] ABSTRACT

An electrical device is disclosed which is small in size and easily assembled. The device employs a rotatable housing and a grooved geometrically programmed disc to locate a ball contact at a desired position on a substrate. The substrate may comprise a resistor, spaced contacts or other conductive surface, and the movable ball contact may change circuit conditions incrementally when compared with the degree of movement of the drive for the ball. The ball has two points of contact with the grooved disc reducing noise and wear. The grooved disc is readily replaceable for changing the operating characteristics of the device.

12 Claims, 14 Drawing Figures

FIG. 6
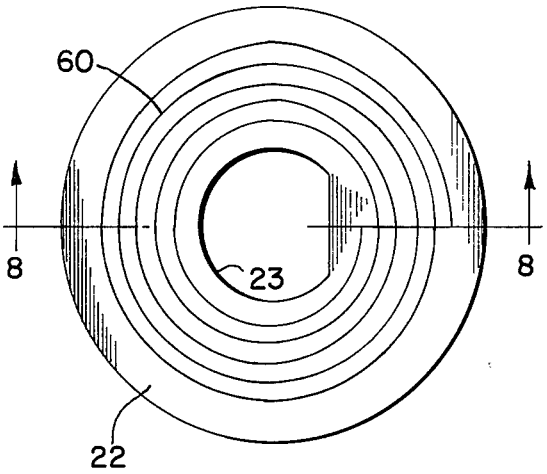
FIG. 7
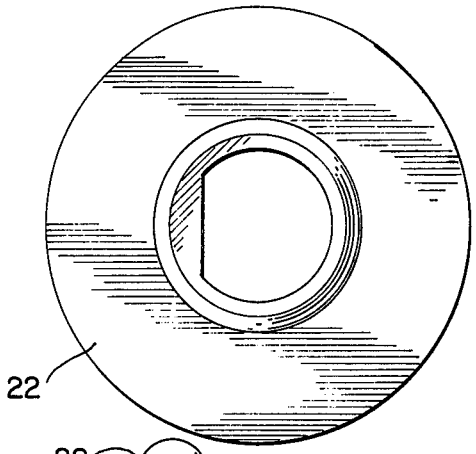
FIG. 8
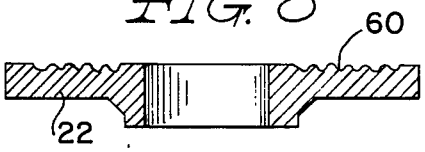
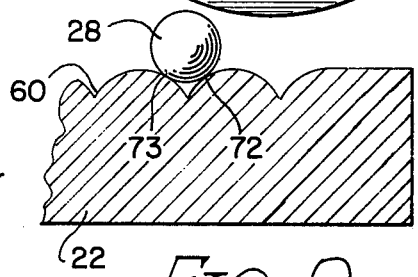
FIG. 9
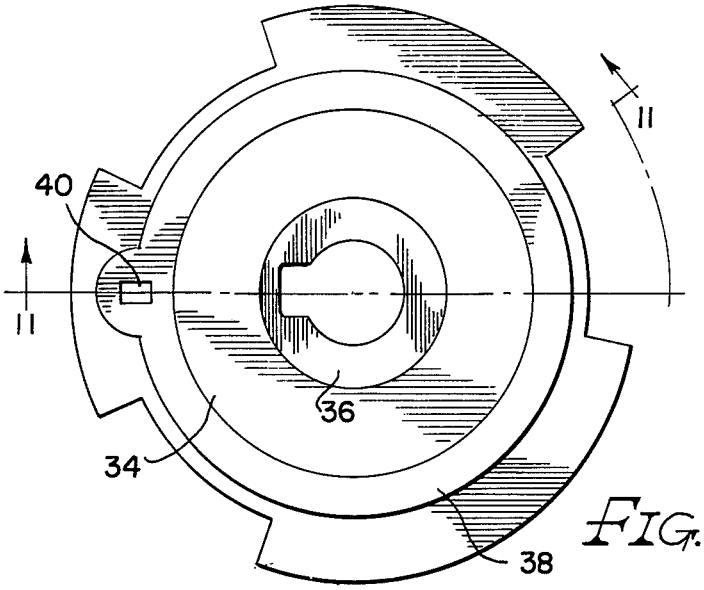
FIG. 10
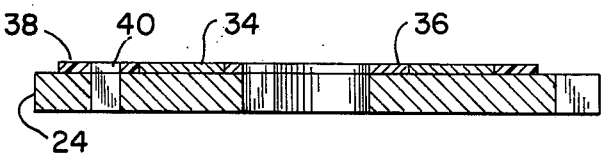
FIG. 11

ELECTRICAL DEVICE

BACKGROUND OF THE INVENTION

This invention relates to electrical potentiometers and similar instruments. In particular, the invention relates to potentiometers and the like which are adjustable between a minimum and maximum resistance or to achieve other electrical circuit variations by the mechanical rotation of a driveable member. Most potentiometers can be classified as fractional turn, single turn or multi-turn types. Where a small potentiometer is desired as, for example, a trimmer potentiometer, it has been customary to use a fractional or single turn miniature potentiometer and by gearing or vernier techniques obtain small size characteristics. This has resulted in increased noise and decreased accuracy.

It is accordingly an object of the present invention to provide a miniaturized potentiometer or similar device which may be fractional, single or multi-turn, which is accurate, and which has low noise characteristics.

It is another object of the invention to provide a potentiometer or similar device which utilizes the direct drive of a ball on an annular resistance element or other element to vary the electrical resistance or other output provided by the device.

It is a further object of the present invention to provide a device of the type described which is capable of being programmed to provide any desired resistance function or other function, in a geometrical pattern such as spiral, elongation, triangulation, parabolic, logarithmic, linear, audio and like patterns.

It is a further object of the present invention to provide such a device wherein its resistance function can be easily changed by the insertion of a differently geometrically programmed grooved disc having a pattern as discussed above.

It is another object of the invention to provide a device which can be miniaturized and which is characterized by a high degree of accuracy, particularly in terms of repeatability.

Other objects and advantages of the invention will be apparent from the remaining portion of the specification.

BRIEF DESCRIPTION OF THE DRAWINGS

FIG. 6 is a bottom plan view of the prrogrammable grooved disc according to a first embodiment of the invention.

FIG. 7 is a top plan view of the programmable disc.

FIG. 8 is a sectional view through the grooved disc of FIG. 6 taken on the indicated lines.

FIG. 9 is an enlarged partial section of the grooves of FIG. 8.

FIG. 10 is a top plan view of the annular resistance element and supporting substrate utilized in the invention.

FIG. 11 is a sectional view through the substrate on the lines indicated in FIG. 10.

SUMMARY OF THE INVENTION

A potentiometer construction is disclosed in which a ball contact is sandwiched between an annular resistance substrate and a grooved disc. Rotation of the drive housing effects movement of the grooved disc causing the ball to move laterally on the substrate according to the spacing of the grooves. By changing the spacings between grooves various resistance functions can be obtained. The device may be small in size if desired and is easily assembled.

DETAILED DESCRIPTION

Figure 1:
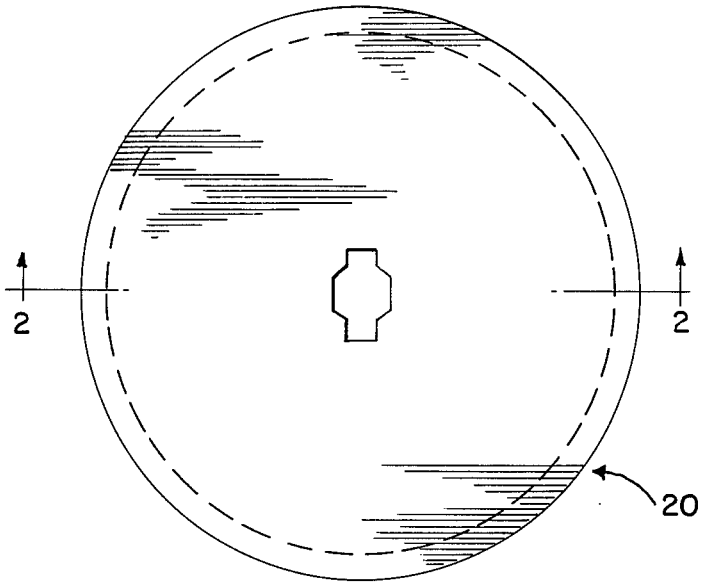
FIG. 1 is a top plan view of the drive housing according to the invention.
Figure 2:
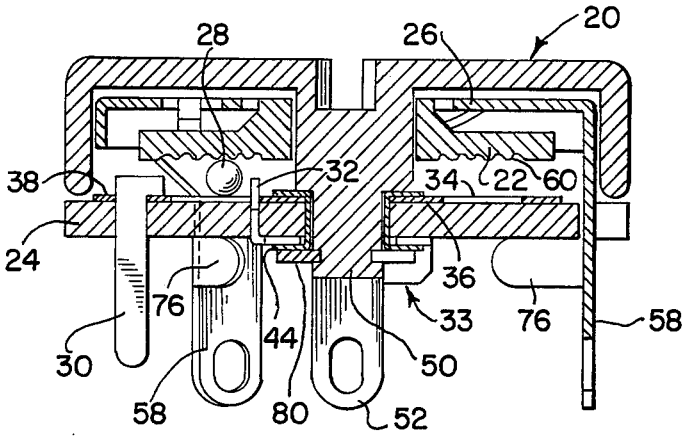
FIG. 2 is a sectional view through the invention taken along the lines 2—2 of FIG. 1.

Referring to FIGS. 1 and 2, there is disclosed a potentiometer construction including a drive housing 20, a geometrically programmable grooved disc 22, a substrate 24, and a contact ring 26. These principal elements are assembled in a manner to be described so as to sandwich a conductive, ball bearing-like contact member 28 between the disc 22 and the substrate 24.

The device may be conveniently described as being formed of two subassemblies each of which will be separately discussed. The first subassembly includes the substrate 24, the outer terminal stop 30, and inner terminal stop 32. Referring to FIGS. 10 and 11, the details of substrate 24 are illustrated. Substrate 24 has deposited thereon an annular resistive coating 34, an inner conductive contact ring 36 and an outer conductive contact ring 38. The outer terminal stop 30 passes through the substrate 24 via opening 40 and is in electrical contact with outer ring 38.

Figure 3:
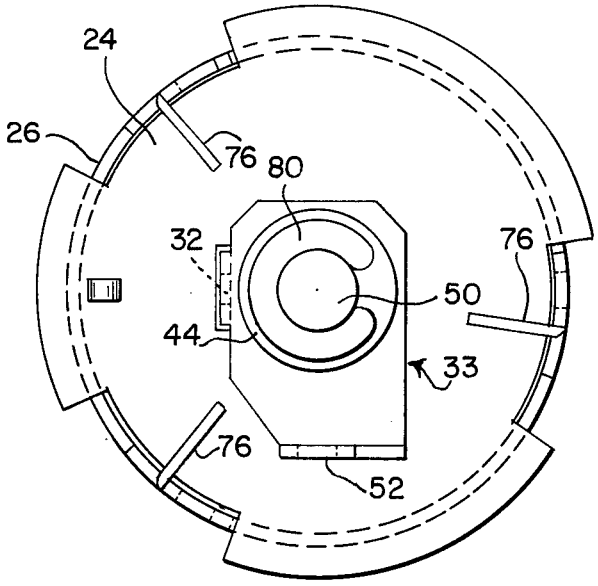
FIG. 3 is a bottom plan view of the invention.

The inner terminal stop 32 is formed integrally with part 33 (FIG. 3), and this part is secured in position on the substrate 24 by retaining eyelet 44 (FIG. 2). Eyelet 44 is inserted into the opening of substrate 24 and also serves as a bearing for the drive housing shaft 50. An electrical path is provided by the stop 32 from the top side of the substrate to the connector lug 52 which is also integral with part 33.

Figure 4:
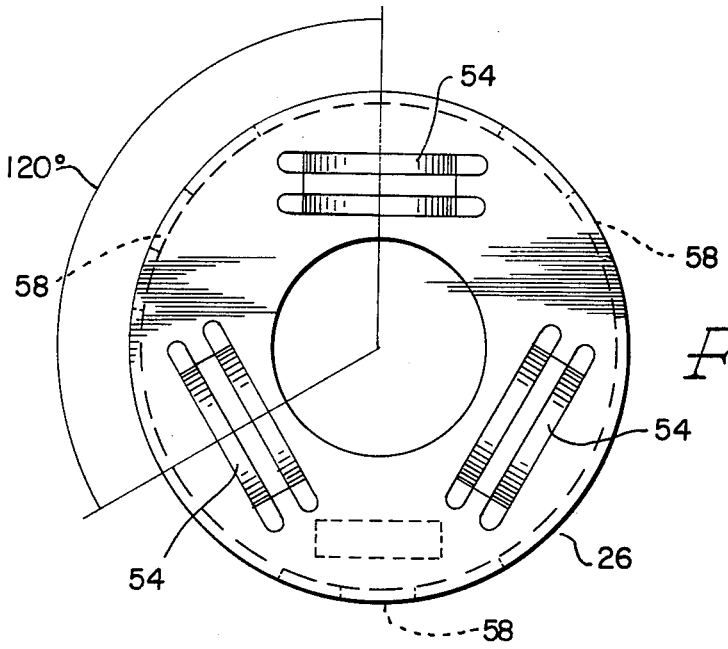
FIG. 4 is a top plan view of the contact ring of the invention.
Figure 5:
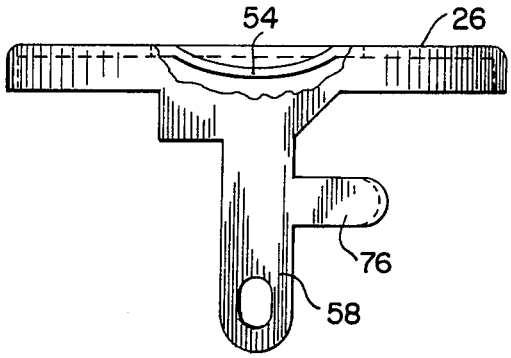
FIG. 5 is a side elevation of the contact ring.

The second subassembly comprises the drive housing 20, the grooved disc 22 and the contact ring 26. The drive housing 20 includes a shaft 50 which is D-shaped over a portion of its extent and, as can be seen by reference to FIGS. 4, 6 and 7, the contact ring 26 and program disc 22 have central openings to permit the shaft 50 to pass therethrough. In order to assemble the second subassembly, the contact ring 26 is placed over the shaft 50 with its spring members 54 facing away from the housing. These members serve to conduct current from connector lugs 58 of the ring to the grooved disc 22. The grooved disc 22 is oriented to align its D-shaped openings 23 with the configuration of shaft 50 and placed thereon with the grooves facing away from the housing. The disc is slip fitted onto the drive housing and is pressed against the spring members 54 of the contact ring 26 whereby it is maintained in contact with the contact ring 26 via these spring members 54.

Referring to FIGS. 6 through 9, the construction details of the grooved disc are illustrated. The disc is electrically conductive and is provided with a generally spiral set of grooves as, for example, grooves 60. As will be apparent, the spacing between adjacent grooves on the disc permits selectable resistance functions. For example, linear, audio, logarithmic and like programming can be obtained. That is, during movement of the drive housing 20, the resistance provided by the potentiometer will vary according to the spacing of the grooves on the disc 22 and an infinite variation in groove patterns is possible.

The respective terminal stops 30 and 32 are located at the opposite ends of the spiral. As will be particularly apparent from the subsequent description of the assembly and operation, the arrangement eliminates any need for precise location of the ball 28. The resistance paths are always on a radial line between the ball and rings 36 and 38, and the ball can always traverse the entire length of the spiral irrespective of its position upon assembly. This is in great contrast to the delicate assembly operations which characterize potentiometers of comparable capability.

Referring to FIG. 9, the redundancy feature of the present invention is illustrated. In this enlarged fragmentary view it can be seen that during movement of the drive housing and disc 22 the ball contact 28 travels along the shoulders 72 and 73 of the groove. Thus, the ball is in contact with the grooved disc at two distinct points at any given moment. This significantly reduces noise tendencies, specifically any tendency for dust and dirt to interfere with good electrical contact between the disc 22 and the ball contact 28. A further advantage of this construction is a significantly reduced wear characteristic and also noise reduction since the ball rolls as it presses against the disc at two points on either side of the groove.

Final assembly of the device is easily accomplished. The ball contact is placed on the inverted grooved disc 22. The substrate subassembly is then inverted and placed onto the shaft 50 of the drive housing. Light pressure is applied to the substrate to maintain it in position, while locking tabs 76 provided on the connector lugs are bent at right angles to permanently secure the substrate on the shaft 50. The drive mechanism is further secured by inserting a retaining ring 80 onto shaft 50 on the underside of the eyelet 44. The ring 80 is resilient and removable thereby facilitating the change of disc 22 and also any maintenance function requiring disassembly.

As will be apparent from FIG. 2, the complete assembly is a three terminal device comprising the terminals 30, 52 (through stop 32) and 58. Three terminals 58 are provided to give three selection points when the device is connected in a circuit. This adds to the convenience of use since the physical location of one terminal may render it virtually inaccessible and the provision of two other choices should solve that difficulty. The three terminals may be designed for insertion in a printed circuit board and this will add to the stability of the device on the board.

It will be apparent that as the housing 20 is rotated for inward lateral movement of the ball on the resistive substrate, the resistance between lugs 52 and 58 will decrease, and as the ball moves outwardly the resistance between these lugs will increase. Of course, the reverse statement is true with reference to the resistance between terminals 30 and 58.

When the drive housing 20 is rotated, it will be apparent that the grooved disc 22 moves with it due to the D-shaped keyway which mates with the shaft 50. The contact ring 26, however, remains stationary as does the substrate 24. Thus, when the housing 20 is moved, the grooved disc moves with it causing the ball 28 to roll and thereby follow the spiral grooves in a helically outward or inward path on the substrate depending upon the direction of rotation.

Since the ball is rolling as the disc 22 moves, the angular distance of movement of the ball will be one-half the angular distance of rotation of the housing 20. The radial distance of movement of the ball will, of course, depend on the configuration of the groove. In any event, it will be appreciated that very small changes in the electrical circuit involved can be achieved even though the housing 20 may be rotated through several degrees. This provides a highly efficient control function since delicate manual or automated adjustments are not needed to achieve fine differences in circuit conditions.

As can be seen in FIG. 10, the current passing from a terminal 58 to the ball and substrate reaches the outer contact ring 38 and the inner contact ring 36 after which it is conducted to the corresponding connector lugs 30 and 52, respectively. The travel limit of the ball is determined by the placement of the terminal stops which extend above the surface of the substrate for that purpose.

Operation

Operation of the potentiometer of FIGS. 1–11 is initiated by external rotation of the drive mechanism. This causes the geometrically programmed disc to rotate, while remaining in electrical contact with the ring 26 and its associated terminals 58. The movement of the grooved disc causes the ball contact 28 to rotate across the resistance substrate either inwardly from the outer terminal stop or outwardly from the inner terminal stop. This results in a selectably variable resistance path.

Figure 12:
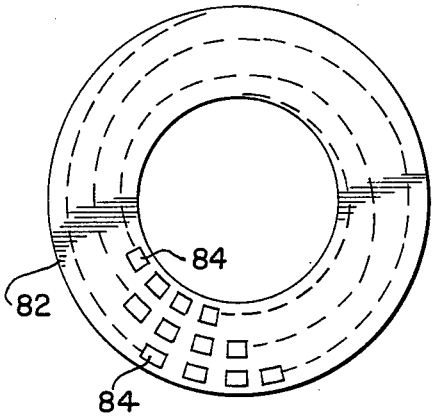
FIG. 12 is a plan view of a contact disc adapted to be utilized in a switching device comprising an alternative form of the invention.
Figure 12A:
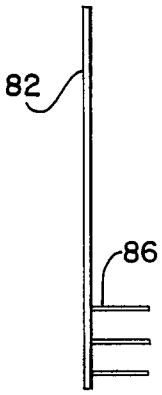
FIG. 12*a* is a side view of the structure of FIG. 12.

FIGS. 12 and 12*a* illustrate a member 82 which is adapted to be substituted for the annular resistor member 34 and the associated contact rings 36 and 38. This member 82 comprises a non-conductive matrix having a plurality of spaced apart conductors 84 formed therein. Each of the conductors 84 is provided with a terminal 86. In the utilization of this arrangement, a substrate such as the substrate 24 would be provided with a plurality of openings for receiving the terminals 86 whereby these terminals would extend outwardly from the bottom of the device. Each terminal would then be available for appropriate connection in an associated circuit.

It will be appreciated that with the arrangement of FIGS. 12 and 12*a*, a multi-position switch is obtained. Thus, as the conductive ball moves over the surface of the member 82, different contacts 84 will be in contact with the ball thereby placing different terminals 86 in circuit with the terminals 58.

The arrangement of FIGS. 12 and 12*a* provides a great number of switch positions while still permitting an operator to turn an actuating knob through a relatively large number of degrees to achieve indexing from one position to the next. For example, the contacts 84 may be positioned 15° a part, and if three rows are provided as illustrated, a total of 72 switch positions becomes available. If an attempt were made to provide this many positions with a conventional switch design, the operator would have only about 5° of movement which would, of course, require great care or sophisticated operating means. With the arrangement of this invention, switching from one position to the next is accomplished with 30° of turn available since the ball moves only ½ the number of degrees of actuator movement. As illustrated, the contact positions are located in a spiral configuration, and the actuating disc will define a corresponding spiral groove.

Figure 13:
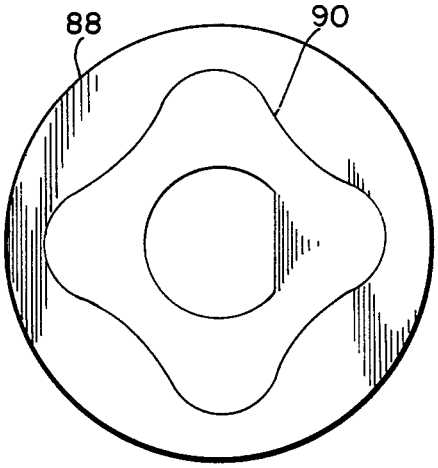
FIG. 13 is a bottom plan view of an alternative form of programmable disc.

FIG. 13 illustrates an additional alternative comprising a disc 88 which may be substituted for the disc 22. In this instance, the grooved path 90 of the disc 88 is endless whereby a regular pattern of resistance change is achieved if the disc is rotated continuously in the same direction. A sine wave pattern of resistance changes may be achieved as well as any other pattern including very irregular patterns for accomodating any particular function. It will be appreciated that once the grooved path is defined by the drive disc, the device requires no difficult or highly sensitive assembly operations even though very complex output patterns may be involved. In this connection, it will also be appreciated that the construction described is readily adaptable for changes in operating characteristics by simply changing either or both of the grooved drive disc and the member carried on the substrate surface. Since the structure is basically held in assembly by means of the flexible washer 80, such changes can be very efficiently accomplished.

It will be understood that various other modifications of the construction described can be made without departing from the spirit of the invention particularly as defined in the following claims.

That which is claimed is:

1. In an electrical device including at least one first terminal, at least one second terminal, a movable contact, and spaced-apart conductors connected to the respective terminals, said movable contact bridging the opposed conductors to complete a circuit between the first and second terminals, said movable contact comprising a conductive ball engaging the surface of one of said conductors; and said other conductor being mounted for rotation relative to said one conductor, the improvement wherein the surface of said one conductor is substantially smooth, said other conductor comprising a drive means for said ball, a grooved path defined by said other conductor, said path extending around the axis of rotation of the other conductor and deviating radially relative to said axis, said ball being held on said grooved path, and means for rotating said other conductor whereby said ball rolls on said surface in response to movement of the other conductor, the path of movement over said surface being controlled by said grooved path.

2. A device in accordance with claim 1 wherein said other conductor comprises a disc, spring means pressing said disc against said ball, said spring means being electrically conductive and being associated with said first terminal.

3. A device in accordance with claim 1 wherein the surface of said one conductor has a resistor supported thereon, said second terminal comprising at least two terminal portions having said resistor positioned therebetween, movement of the ball over said resistor simultaneously varying the resistance between said first terminal and each of said terminal portions.

4. A device in accordance with claim 3 wherein said resistor comprises an annular member, inner and outer annular conductive rings connected to said resistor and located on said surface, one of said terminal portions being connected to each of said rings.

5. A device in accordance with claim 4 wherein said grooved path follows a line extending from a position on said other conductor opposite one of said terminal portions to a position on said other conductor opposite said other terminal portion.

6. A device in accordance with claim 5 wherein said grooved path extends for at least two revolutions around said axis.

7. A device in accordance with claim 1 wherein said grooved path is V-shaped in cross section whereby said ball always has two-point contact with said groove.

8. A device in accordance with claim 1 wherein said grooved path follows an endless line extending over the surface of said other conductor.

9. A device in accordance with claim 1 wherein said one conductor is divided into a plurality of conductors formed in spaced apart relationship over said surface, said second terminal comprising a plurality of individual terminal portions connected to the respective conductors of said plurality of conductors, movement of said ball over said surface resulting in successive bridging between said other conductor and one of said plurality of conductors.

10. A device in accordance with claim 1 including a contact ring, said first terminal comprising an extension of said contact ring, and spring means associated with said contact ring for engaging said other conductor for holding said other conductor in engagement with said ball.

11. A device in accordance with claim 10 wherein said one conductor is positioned on a supporting substrate, said first terminal including means for attaching said contact ring to said substrate, separation of said contact ring and said substrate exposing said other conductor to permit replacement of said other conductor.

12. A device in accordance with claim 11 including a housing surrounding said contact ring and said other conductor, means for attaching said housing to said substrate, said housing being rotatable relative to said substrate, and means for operatively connecting said other conductor to said housing whereby rotation of said housing operates to move said other conductor relative to said one conductor.

* * * * *